US005537845A

United States Patent [19]

Lin

[11] Patent Number: 5,537,845

[45] Date of Patent: Jul. 23, 1996

[54] SYNCHRONOUS CLOTH-ROLLING APPARATUS OF A KNITTING MACHINE

[76] Inventor: Chin-Yung Lin, No. 57, Wu Chone 7th Rd., Wu Gu Industry Area. Wu Gu hsiang, Taipei, Taiwan

[21] Appl. No.: 434,140

[22] Filed: May 2, 1995

[51] Int. Cl.[6] ..... D04B 15/88; D04B 27/34

[52] U.S. Cl. ..... 66/151; 66/153

[58] Field of Search ..... 66/147, 149 R, 66/150, 152, 153; 242/390, 390.8, 397, 398

[56] References Cited

U.S. PATENT DOCUMENTS

| | | | |
|---|---|---|---|
| 4,261,187 | 4/1981 | Yang | 66/151 |
| 4,671,083 | 6/1987 | Sawazaki et al. | 66/151 |
| 4,879,886 | 11/1989 | Okada et al. | 66/151 |

*Primary Examiner*—C. D. Crowder
*Assistant Examiner*—Larry D. Worrell, Jr.
*Attorney, Agent, or Firm*—Pro-Techtor International

[57] ABSTRACT

A synchronous cloth-rolling apparatus of a knitting machine, including a base fixed on the ground, lateral supports, a cloth-rolling mechanism and a cloth-pulling mechanism. The cloth-rolling mechanism and the cloth-pulling mechanism respectively include a cloth-rolling shaft and a cloth-pulling shaft respectively extending from two sides of the base to connect with bottom ends of the lateral supports. The top ends of the lateral supports are fixed under a knitting rotary disk of the knitting machine. A main shaft is disposed on a center of the base. A sleeve is fitted around the main shaft with two bearings positioned therebetween. A compound bevel gear is fitted around the sleeve with two bearings positioned therebetween. The compound bevel gear has upper teeth meshing with a cloth-pulling bevel gear disposed at a rear end of the cloth-pulling shaft and lower teeth meshing with a torque bevel gear of a torque motor. A fixed bevel gear is secured at a top end of the main shaft and meshes with a cloth-rolling bevel gear disposed at a rear end of the cloth-rolling shaft. When the knitting rotary disk is rotated to drive the two lateral supports to rotate about the base, the cloth-rolling bevel gear planetarily revolves about the fixed bevel gear to make the cloth-rolling shaft rotate.

2 Claims, 4 Drawing Sheets

SYNCHRONOUS CLOTH-ROLLING APPARATUS OF A KNITTING MACHINE

BACKGROUND OF THE INVENTION

1. Field of the Invention

The present invention relates to a synchronous cloth-rolling apparatus of a knitting machine, and more particular to a cloth-rolling apparatus which is able to totally synchronously pull and roll the cloth by stable speed and torque so as to avoid uneven yard weight of the cloth and false pulling due to unstable cloth-pulling speed and different cloth-pulling torque.

2. Description of the Prior Art

FIG. 1 shows a conventional cloth-rolling apparatus of a knitting machine, which is composed of a base 81, a cloth-pulling motor 821, a cloth-rolling motor 822, a cloth-rolling lever 831, a belt 84, a cloth-pulling lever 85, a knitting rotary disk 86 and a knitting motor 87. The knitting motor 87 serves to drive the knitting rotary disk 86 to perform the knitting operation- The cloth-pulling motor 821 and cloth-rolling motor 822 can synchronously rotate to drive the cloth-rolling lever 83 and cloth-pulling lever 85 to synchronously rotate and roll the cloth. In addition, the cloth-pulling motor 821 through the belt 84 drives the cloth-pulling lever 85 to rotate and pull the cloth 88. Therefore, the knitting operation and cloth-pulling and rolling operation can be performed at the same time. However, several shortcomings exist in the conventional apparatus as follows:

1. The rotary speeds of the cloth-pulling motor 821 and the cloth-rolling motor 822 cannot be controlled to a totally synchronous state so that the rotary speeds thereof are somewhat different from each other and are not in conformity with the rotary speed of the knitting rotary disk 86. This causes differences between the rolling speeds of the cloth between the disk 86 and the cloth-pulling lever 85 and the cloth between the cloth-pulling lever 85 and the cloth-rolling lever 83. Therefore, the rolled cloth 88 has uneven thickness (uneven yard weight).

2. The cloth-pulling lever 85 is directly driven by the cloth-pulling motor 821 through the belt 84, while the cloth-rolling motor 822 directly (or indirectly) drives the cloth-rolling lever 83. Therefore, the rotary speeds thereof cannot be controlled to a totally synchronous state. In addition, the cloth-pulling lever 85 will be affected by the weight of the rolled cloth to have a rotary speed different from that of the cloth-rolling lever 83. This will cause a reverse gravitational torque and result in differences between the pulling force of the cloth between the disk 8 and cloth-pulling lever 85 and the cloth between the cloth-pulling lever 85 and cloth-rolling lever 83. Therefore, a false pulling of the rolled cloth may take place.

Therefore, it is necessary to provide an improved cloth-rolling apparatus to eliminate the above shortcomings.

SUMMARY OF THE INVENTION

It is a primary object of the present invention to provide a synchronous cloth-rolling apparatus of a knitting machine, which includes a base fixed on the ground, lateral supports, a cloth-rolling mechanism and a cloth-pulling mechanism. The cloth-rolling mechanism and the cloth-pulling mechanism respectively include a cloth-rolling shaft and a cloth-pulling shaft respectively extending from two sides of the base to connect with bottom ends of the lateral supports. The top ends of the lateral supports are fixed under a knitting rotary disk of the knitting machine. A main shaft is disposed on a center of the base. A sleeve is fitted around the main shaft and a compound bevel gear is fitted around the sleeve. The compound bevel gear has upper teeth meshing with a cloth-pulling bevel gear disposed at a rear end of the cloth-pulling shaft and lower teeth meshing with a torque bevel gear of a torque motor. A fixed bevel gear is secured at a top end of the main shaft and meshes with a cloth-rolling bevel gear disposed at a rear end of the cloth-rolling shaft. When the knitting rotary disk is rotated to drive the two lateral supports to rotate about the base, the cloth-rolling bevel gear planetarily revolves about the fixed bevel gear to make the cloth-rolling shaft synchronously rotate at a speed in accordance with that of the knitting rotary disk. Meanwhile, the cloth-rolling shaft through a belt and an idle roller drives a cloth-rolling lever to synchronously roll the cloth passing through several cloth-pulling levers. Therefore, the shortcoming of uneven thickness (yard weight) of the rolled cloth due to different rotary speeds of the cloth-rolling lever and knitting rotary disk can be eliminated.

It is a further object of the present invention to provide the above apparatus in which when the cloth-rolling bevel gear planetarily revolves about the fixed bevel gear to make the cloth-rolling shaft rotate, the rolled cloth exerts a frictional force on the cloth-pulling levers and creates a torque to rotate the cloth-pulling shaft, so that the cloth-pulling levers are also synchronously rotated at a speed as that of the cloth-rolling lever. One of the multiple cloth-pulling levers, which is located at a position higher than those of the other cloth-pulling levers is connected to the cloth-pulling shaft through a belt, whereby the torque motor provides a stable rotary speed and torque in accordance with the planetary motion of the cloth-rolling shaft and cloth-pulling shaft relative to the main shaft so that the cloth-pulling levers and cloth-rolling lever can perform the cloth-pulling operation and cloth-rolling operation synchronously at stable speed and torque.

The present invention can be best understood through the following description and accompanying drawings, wherein:

DETAILED DESCRIPTION OF THE PREFERRED EMBODIMENT

Figure 1:
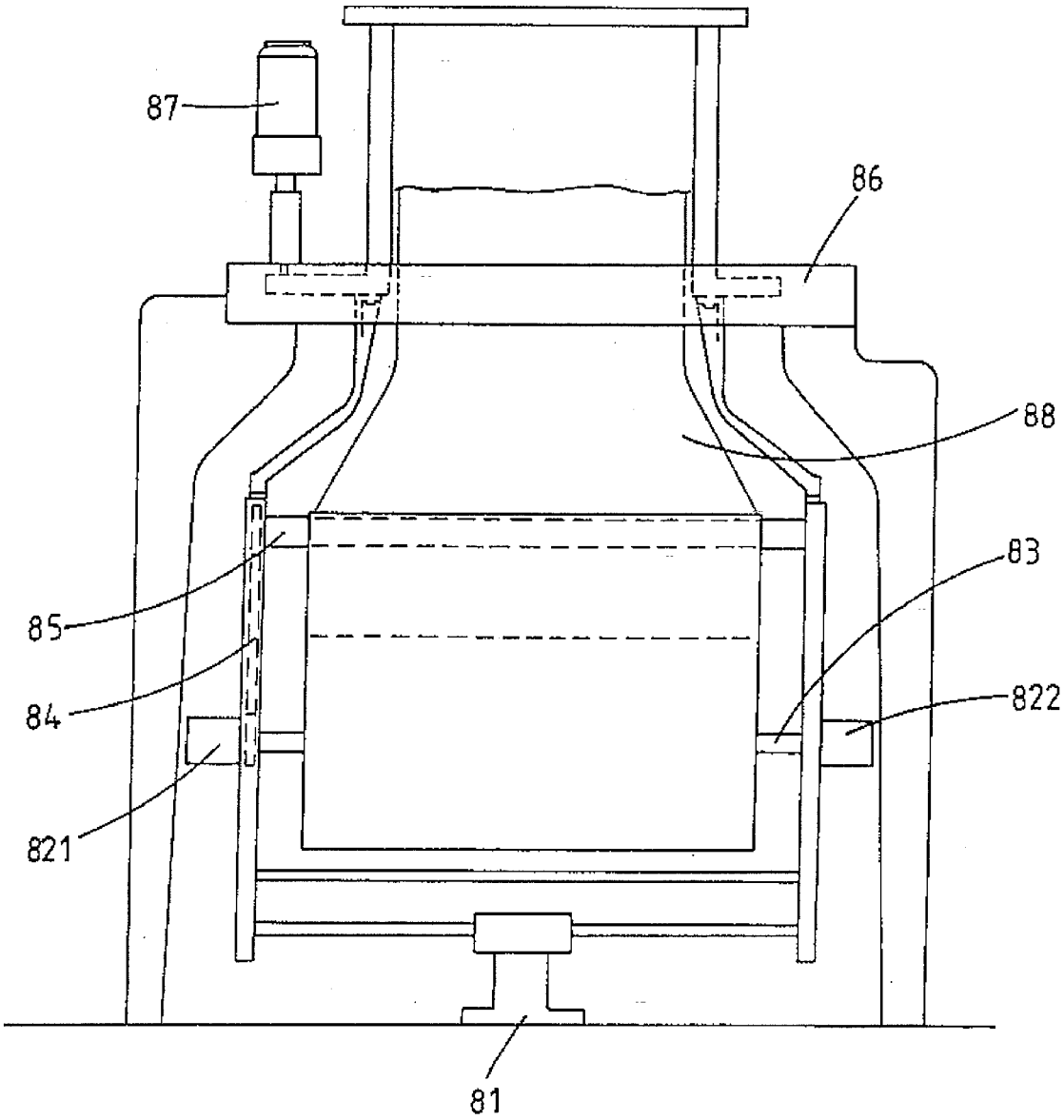
Fig. 1 PRIOR ART.
FIG. 1 is an elevation of a conventional cloth-rolling apparatus of a knitting machine.
Figure 2:
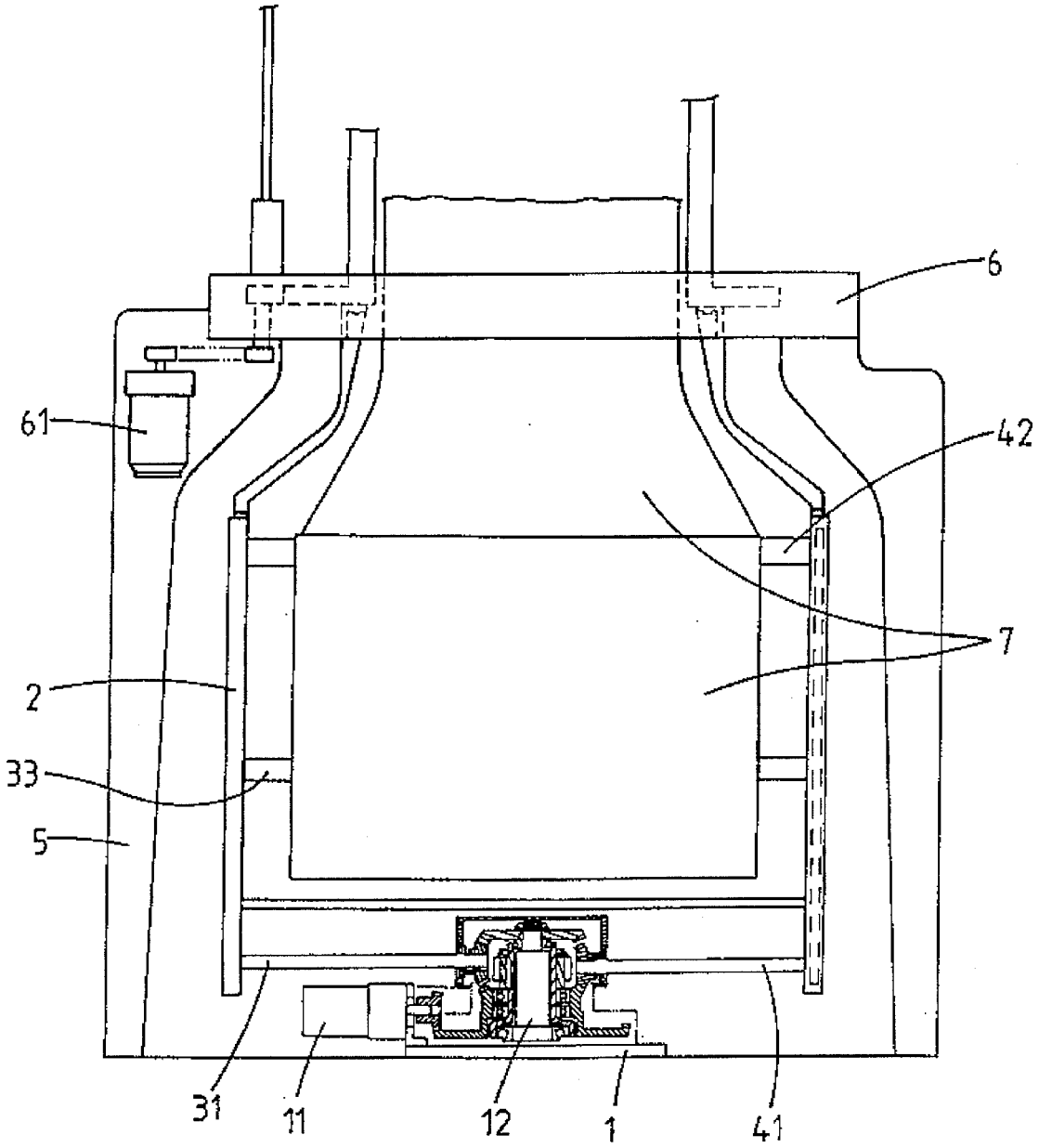
FIG. 2 is an elevation of the cloth-rolling apparatus of the present invention.
Figure 3:
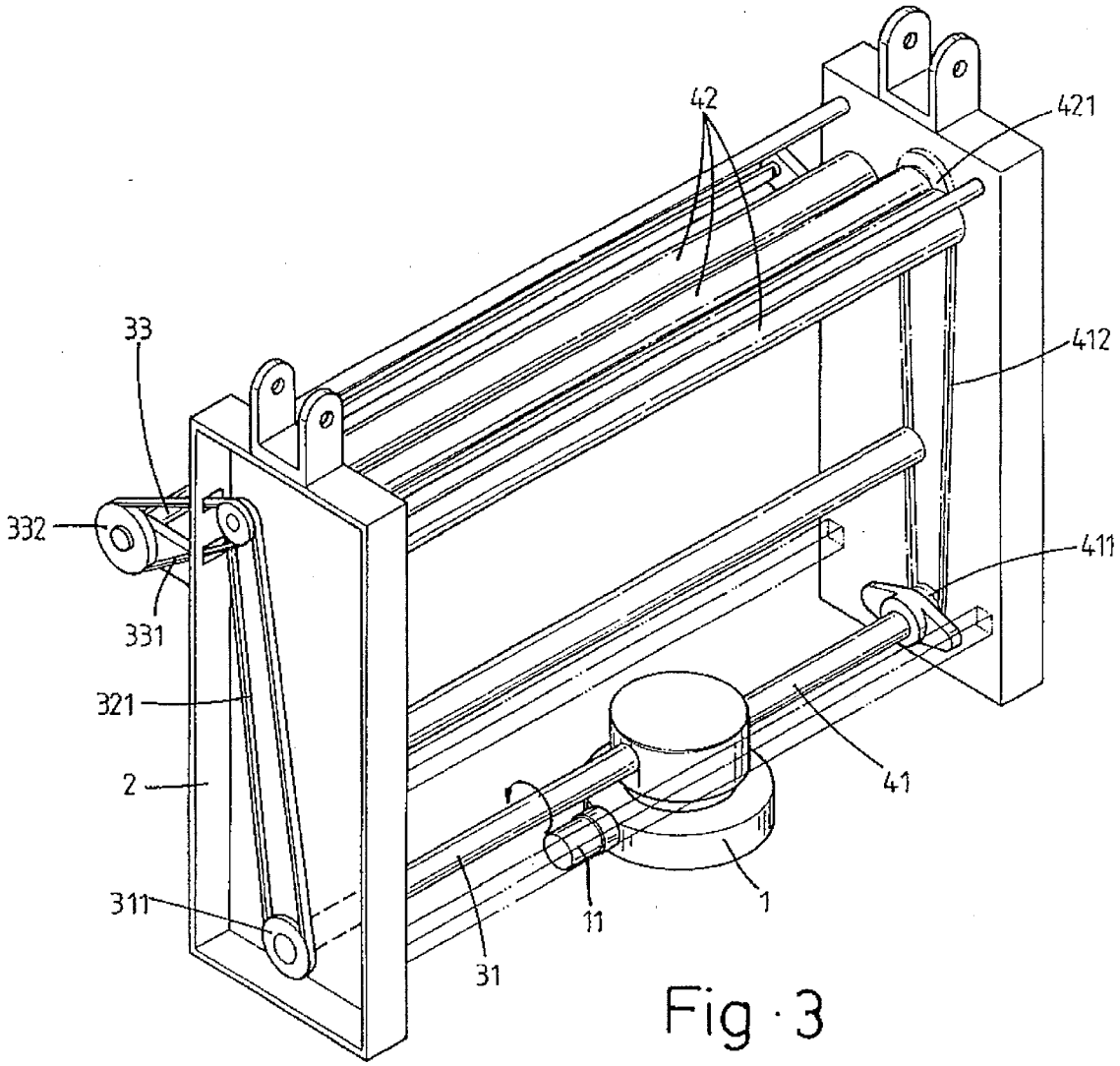
FIG. 3 is a perspective assembled view of the present invention.

Please refer to FIGS. 2 and 3. The cloth-rolling apparatus of the present invention mainly includes a base 1, two lateral supports 2, a cloth-rolling mechanism 3 and a cloth-pulling mechanism 4. The base 1 is fixed on the ground. A cloth-rolling shaft 31 of the cloth-rolling mechanism 3 and a cloth-pulling shaft 41 of the cloth-pulling mechanism 4 respectively extend from two sides of the base 1 to connect with bottom ends of the lateral supports 2. The top ends of the lateral supports 2 are fixed under a knitting rotary disk 6 of a knitting machine. The knitting rotary disk 6 is supported by a main support 5 and driven by a knitting motor 61. The cloth-rolling mechanism 3 further includes a lower cloth-rolling wheel 311 disposed at a front end of the cloth-rolling shaft 31 and an upper cloth-rolling wheel 332 fixed at one end of a cloth-rolling lever 33- The lower cloth-rolling wheel 311 is connected to an idle roller 32 by a first belt 321 and the upper cloth-rolling wheel 332 is connected to the idle roller by a second belt 331. The cloth-pulling mechanism 4 further includes a lower cloth-pulling wheel 411 disposed at a front end of the cloth-pulling shaft 41 and an upper cloth-pulling wheel 421 fixed at one end of a cloth-pulling lever 42 and connected with the lower cloth-pulling wheel 411 by a third belt 412.

Figure 4:
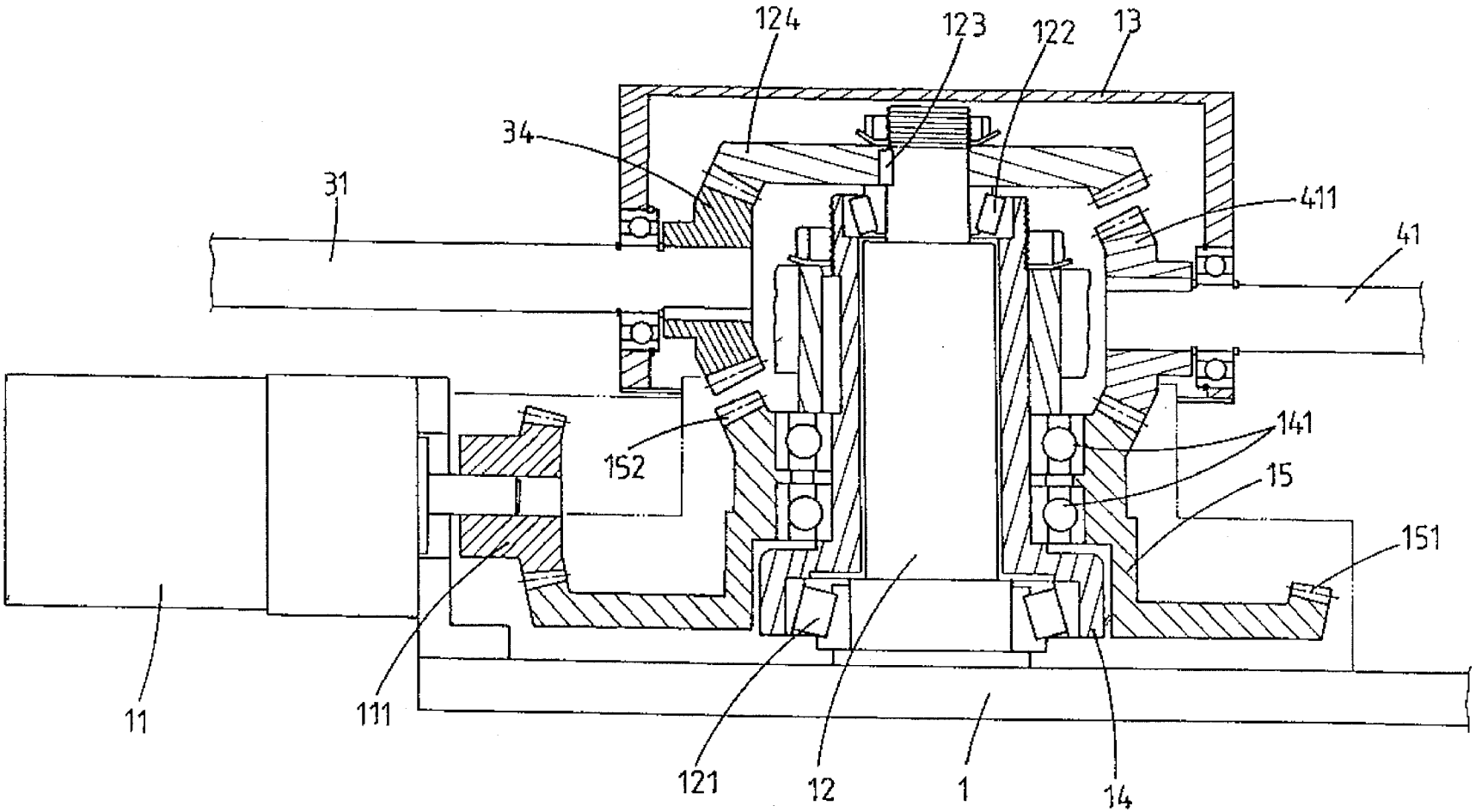
FIG. 4 is a sectional view of the base of the present invention.

Referring to FIG. 4, a main shaft 12 is disposed on a center of the base 1. Two roller bearings 122, 121 are respectively disposed at an upper and a lower ends of the main shaft 12 and a sleeve 14 is fitted around the main shaft 12 with the roller bearings 122, 121 positioned therebetween. A compound bevel gear 15 is fitted around the sleeve 14 with two ball bearings 141 positioned therebetween. The compound bevel gear 15 has upper teeth 152 meshing with a cloth-pulling bevel gear 411 disposed at a rear end of the cloth-pulling shaft 41 and lower teeth 151 meshing with a torque bevel gear 111 of a torque motor 11. A fixed bevel gear 124 is secured at a top end of the main shaft 12, which meshes with a cloth-rolling bevel gear 34 disposed at a rear end of the cloth-rolling shaft 31.

When the knitting rotary disk 6 is rotated to drive the two lateral supports 2 to rotate about the base 1, the cloth-rolling bevel gear 34 at the rear end of the shaft 31 planetarily revolves about the fixed bevel gear 124 at the top end of the main shaft 12, making the cloth-rolling shaft 31 rotate. Meanwhile, the lower cloth-rolling wheel 311 through the belt 331 drives the idle roller 32 to rotate and in turn through the belt 331 drive the upper cloth-rolling wheel 332 to rotate. The upper cloth-rolling wheel 332 then drives the cloth-rolling lever 33 to rotate and roll a piece of cloth 7. The rolled cloth 7 previously passes through multiple cloth-pulling levers 42 disposed thereabove. The upper cloth-pulling wheel 421 is disposed at one end of one of the multiple cloth-pulling levers 42, which is located at a position higher than those of the other cloth-pulling levers 42.

When the knitting rotary disk 6 rotates the lateral supports 2 to further rotate the cloth-pulling shaft 41, because the more the cloth is rolled around the cloth-rolling lever 33, the greater the downward pulling force exerted on the cloth between the cloth-rolling lever 33 and the cloth-pulling levers 42 is, the cloth 7 passing through the cloth-pulling levers 42 will exert a frictional force on the cloth-pulling shaft 41 and create a torque so as to accelerate the rotary speed thereof. At this time, because the torque motor 11 rotates at constant speed with a fixed torque, the motor 11 will create an accelerating effect and the rotary speed of the cloth-pulling shaft 41 will be positively accelerated by a certain value until the rotary speed thereof is equal to that of the knitting rotary disk 6. Then, the motor 11 reversely synchronously rotates in accordance with the rotary speed of the cloth-rolling lever 33 and cloth-rolling shaft 31. In the case that the cloth rolled around the cloth-rolling lever 33 is lighter and the frictional force exerted on the cloth-pulling levers 42 by the cloth is smaller, the rotary speed of the cloth-pulling levers 42 will be faster than that of the cloth-rolling lever 33. Under such circumstance, the motor 11 will create a decelerating effect to brake and decelerate the cloth-pulling levers 42 in accordance with the rotary speed of the cloth-rolling lever 33 and cloth-rolling shaft 31. Therefore, the torque motor 11 provides a stable rotary speed and torque in cooperation with the planetary synchronous motion of the cloth-rolling shaft 31 and cloth-pulling shaft 41 relative to the main shaft 12 so that the cloth can be stably and synchronously pulled and rolled.

In conclusion, the synchronous cloth-rolling apparatus of the present invention is able to roll and pull the cloth synchronously with-the knitting motion so that the quality of the cloth is stable and the shortcomings of the conventional cloth-rolling apparatus can be eliminated.

The above description and accompanying drawings are used only for illustrating a preferred embodiment of the present invention and not intended to limit the scope thereof. Many derivations or modifications of the preferred embodiment can be made without departing from the spirit of the present invention.

What is claimed is:

1. A synchronous cloth-rolling apparatus of a knitting machine, comprising:

a base affixed to a supporting surface, lateral supports including bottom and top ends, a cloth-rolling mechanism and a cloth-pulling mechanism, wherein;

the cloth-rolling mechanism includes a cloth-rolling shaft with a front and a rear end and the cloth-pulling mechanism includes a cloth-pulling shaft with a front and rear end, the cloth-rolling shaft and cloth-pulling shaft being connected with the bottom ends of the lateral supports and revolving about a fixed bevel gear secured on a main shaft of the base and a compound bevel gear fitted around the main shaft of the base, the top ends of the lateral supports being fixed under a knitting rotary disk of the knitting machine and synchronously rotatable along with the knitting rotary disk, the cloth-rolling mechanism further including a lower cloth-rolling wheel disposed at the front end of the cloth-rolling shaft and an upper cloth-rolling wheel fixed at one end of a cloth-rolling lever, the lower cloth-rolling wheel being connected to an idle roller by a first belt and the upper cloth-rolling wheel being connected to the idle roller by a second belt, the cloth-pulling mechanism further including a lower cloth-pulling wheel disposed at the front end of the cloth-pulling shaft and an upper cloth-pulling wheel fixed at one end of a cloth-pulling lever and connected with the lower cloth-pulling wheel by a third belt, the rear end of the cloth-pulling shaft being connected to a torque motor through the compound bevel gear meshing with the torque motor, the torque motor being adapted to rotate at constant speed with fixed torque.

2. A cloth-rolling apparatus as claimed in claim 1, wherein:

the main shaft includes a top end and is disposed on a center of the base and a sleeve is fitted around the main shaft with two bearings positioned therebetween, the compound bevel gear being fitted around the sleeve with two bearings positioned therebetween, the compound bevel gear having upper teeth meshing with a cloth-pulling bevel gear disposed at the rear end of the cloth-pulling shaft and lower teeth meshing with a torque bevel gear of the torque motor, the fixed bevel gear being secured at the top end of the main shaft and meshing with a cloth-rolling bevel gear disposed at the rear end of the cloth-rolling shaft.

* * * * *